US007503339B1

(12) United States Patent
Bogan et al.

(10) Patent No.: US 7,503,339 B1
(45) Date of Patent: Mar. 17, 2009

(54) COVER FOR LIFT STATIONS

(75) Inventors: Timothy D. Bogan, Roseburg, OR (US); Mark Sheldon, Bend, OR (US)

(73) Assignee: Romtec Utilities, Inc., Roseburg, OR (US)

( * ) Notice: Subject to any disclaimer, the term of this patent is extended or adjusted under 35 U.S.C. 154(b) by 470 days.

(21) Appl. No.: 11/036,622

(22) Filed: Jan. 12, 2005

(51) Int. Cl.
*F16K 27/00* (2006.01)

(52) U.S. Cl. ..... 137/364; 417/360; 417/36

(58) Field of Classification Search ..... 137/364, 137/363; 417/36, 360; 52/19–21
See application file for complete search history.

(56) References Cited

U.S. PATENT DOCUMENTS

| | | | | |
|---|---|---|---|---|
| 2,217,097 | A | 10/1940 | Brooks | |
| 2,497,969 | A | 2/1950 | Anderson | |
| 2,832,614 | A | 4/1958 | Settle, Jr. | |
| 3,112,760 | A | 12/1963 | Budd | |
| 3,375,788 | A | 4/1968 | Solas et al. | |
| 3,461,803 | A | 8/1969 | Stothoff, III et al. | |
| 3,525,353 | A | 8/1970 | Parks | |
| 3,726,610 | A * | 4/1973 | Butterfield | 417/360 |
| 3,810,261 | A | 5/1974 | Hollander | |
| 3,891,224 | A | 6/1975 | Ditcher | |
| 3,938,545 | A | 2/1976 | Nagy et al. | |
| 3,980,311 | A | 9/1976 | Ditcher | |
| 4,023,590 | A | 5/1977 | Harris et al. | |
| 4,253,282 | A | 3/1981 | Swartz | |
| 4,335,740 | A * | 6/1982 | Boley | 137/364 |
| 4,340,081 | A | 7/1982 | Watson | |
| 4,472,911 | A | 9/1984 | Jooris et al. | |
| 4,540,310 | A | 9/1985 | Ditcher et al. | |
| 4,706,718 | A | 11/1987 | Milo | |
| 4,865,526 | A | 9/1989 | Clark et al. | |
| 4,867,871 | A | 9/1989 | Bowne | |
| 5,076,456 | A | 12/1991 | Geyer | |
| 5,235,132 | A * | 8/1993 | Ainsworth et al. | 174/36 |
| 5,423,447 | A | 6/1995 | Youngs | |
| 5,435,664 | A | 7/1995 | Pettersson | |
| 5,542,780 | A | 8/1996 | Kourgli | |
| 5,544,460 | A | 8/1996 | Fife | |
| 5,617,679 | A | 4/1997 | Meyers | |

(Continued)

OTHER PUBLICATIONS

Tipton Environmental International Inc., Lift Station, www.tipton.org/lift_station2.html, pp. 1-2, 2000.

*Primary Examiner*—John Rivell
*Assistant Examiner*—Cloud K Lee
(74) *Attorney, Agent, or Firm*—Klarquist Sparkman, LLP

(57) ABSTRACT

A cover assembly for a lift station is disclosed. The cover assembly includes a cover in which an access opening, a cable passageway and a vent are defined. The cable passageway has one end that connects to the access opening and another end that opens to an exterior of the lift station. The cable passageway and the access opening are covered by hatches that can be opened to fully uncover the cable passageway and a portion of the access opening adjacent the cable passageway. This facilitates installation and maintenance of cables running between external equipment and internal equipment. The hatch covering the cable passageway is substantially solid to prevent venting of flammable gases. An interior of the cable passageway has an additional barrier to these gases. The vent is spaced apart from the cable passageway to further separate the cable passageway and external equipment from flammable gases.

28 Claims, 4 Drawing Sheets

U.S. PATENT DOCUMENTS

| | | | | |
|---|---|---|---|---|
| 5,658,135 | A | 8/1997 | Sodergard | |
| 5,826,887 | A | 10/1998 | Neumann et al. | |
| 5,924,846 | A | 7/1999 | Arnold, Jr. et al. | |
| 5,934,315 | A | 8/1999 | Braswell et al. | |
| 6,047,724 | A | 4/2000 | Nurse, Jr. | |
| 6,349,517 | B1 * | 2/2002 | Manley et al. | 52/239 |
| 6,364,620 | B1 * | 4/2002 | Fletcher et al. | 417/36 |
| 6,435,204 | B2 * | 8/2002 | White et al. | 137/234.6 |
| 6,644,342 | B1 | 11/2003 | Bogan et al. | |
| 6,772,782 | B2 | 8/2004 | Bogan et al. | |
| 2003/0037818 | A1 * | 2/2003 | Helle | 137/364 |
| 2004/0089345 | A1 * | 5/2004 | Bogan et al. | 137/364 |

* cited by examiner

COVER FOR LIFT STATIONS

FIELD

This disclosure concerns covers for lift stations and methods for covering lift stations, such as wastewater lift stations, particularly with regard to cable routing and/or venting.

BACKGROUND

Lift stations are used to lift water, including wastewater or storm water, or other liquid from one elevation to a higher elevation. In a typical lift station for wastewater, an in-ground well receives wastewater through an inlet in a side wall of the well. The wastewater accumulates within the well until it reaches a predetermined level, at which point a submersible pump or other wastewater moving device in the well is automatically triggered to begin evacuating the wastewater through an outlet in the side wall located at an elevation higher than the inlet. The elevation of the outlet can be, for example, an elevation sufficient to allow the evacuated wastewater to flow by gravity, such as via a sewer main to a municipal wastewater treatment plant. The pump continues operating until the level of accumulated wastewater in the well decreases to a second predetermined level.

The pumps, level sensors and other equipment located within a wastewater lift station typically must be connected to power sources, control panels and other equipment located outside the wastewater lift station. In most conventional wastewater lift stations, electrical cables to form these connections are routed out a side wall of the well, through an underground conduit and up into an electrical box. This configuration of cables can be expensive to install and difficult to maintain. In contrast, commonly assigned U.S. Pat. No. 6,772,782 ("the '782 patent") discloses a channel in the wastewater lift station cover through which cables can be routed. In the '782 patent, this channel is partially covered by a grate so that it also serves as a vent.

In some circumstances, venting a wastewater lift station through the channel that carries cables can be disadvantageous. For example, some conditions can cause flammable gases to be created inside wastewater lift stations. These gases can be ignited by quick-disconnect plugs, power sources, and other external electrical equipment to which the devices within wastewater lift stations must be connected. Several building codes, including the National Fire Code, require ignition sources to be located a safe distance, such as 60 inches or more, from sources of flammable gas. Under some circumstances, a vent opening to the interior of a wastewater lift station can be classified as a source of flammable gas. It would be desirable to provide an integrated solution to cable routing and venting that addresses some of these concerns.

SUMMARY

Disclosed herein is a cover assembly for a lift station. Embodiments of the disclosed cover assembly can provide an integrated solution to cable routing and venting and additionally can provide improvements in durability, security and ease of installation.

The cover assembly can define an access opening, a cable passageway and a vent. The cable passageway can be configured to extend from an exterior of the lift station to an interior of the lift station. The cable passageway, for example, can extend into the interior of the lift station through a side wall of the access opening. In some embodiments, the access opening and an opening of the cable passageway adjacent the access opening occupy intersecting planes, such as planes intersecting at an angle of about 90°. When the cover assembly is positioned over a lift station well, the cable passageway can be substantially horizontal and the access opening can be substantially vertical.

The cable passageway and the access opening can be covered by a cable-passageway hatch and an access-opening hatch, respectively. In some embodiments, the cable-passageway hatch is substantially contiguous with the access-opening hatch when the cable-passageway hatch and the access-opening hatch are closed. In this configuration, the cable-passageway hatch can be partially secured by the access-opening hatch. For example, the cable-passageway hatch can include a lip configured to extend under the access-opening hatch when the cable-passageway hatch and the access-opening hatch are closed.

In some embodiments, the cable passageway and a portion of the access opening adjacent the cable passageway can be fully uncovered when the cable-passageway hatch and the access-opening hatch are opened. This can allow cables extending from the exterior of the lift station to the interior of the lift station to be placed into or lifted out of the cable passageway without being threaded through any closed spaces within the cable passageway or within the portion of the access opening adjacent the cable passageway.

The cable passageway can include additional features, such as a divider configured to separate power cables from signal cables. In some embodiments, a barrier is positioned in the cable passageway to substantially block airflow through the cable passageway. This barrier can be, for example, a foamed polymer or a cable support. The cable support can be a plate positioned transverse to the cable-passageway's length and including openings configured to fit around cables. To facilitate the placement and removal of these cables, the cable support can be divided along the openings into pieces that can be separated and then reassembled around the cables.

The vent can be spaced from the cable passageway. In some embodiments, the cable passageway and the vent are isolated by the access opening. For example, the vent and the cable passageway can be positioned on opposite sides of the access opening. To prevent the cable passageway from acting as a vent, the cable-passageway hatch can be substantially solid.

In some embodiments, the cover assembly has a flat upper surface. This can be achieved, for example, by recessing the cable passageway relative to the top surface of the cover assembly. In addition, the top surfaces of the access-opening hatch, cable-passageway hatch and vent can be substantially flush with the top surface of the overall cover assembly.

A disconnect box can be positioned above the top surface of the cover assembly on a disconnect box stand extending from the end of the cable passageway that opens to the exterior of the lift station. The disconnect-box stand can have a disconnect-box stand door with a bottom edge that overlaps the cable-passageway hatch when the disconnect-box stand door and the cable-passageway hatch are closed. This can prevent the cable-passageway hatch from being opened without first opening the disconnect-box stand door.

In addition to embodiments of the overall lift station cover, this disclosure also describes components of a lift station cover, including a shell assembly. The disclosed shell assembly can include an access-opening shell, a cable-passageway shell and a vent shell, defining the access opening, cable passageway and vent, respectively. To form a complete lift station cover, the shell assembly can be surrounded by a support structure, such as a poured concrete support structure. Aside from the support structure, the shell assembly can include all of the elements discussed above according to the same or similar configurations. For example, the vent shell and the cable-passageway shell can be positioned adjacent the access-opening shell on opposite sides of the access-opening shell. In some embodiments, the access-opening shell is separable from the cable-passageway shell and is configured to be connected to the access-opening shell. Similarly, the vent shell can be separable from the access-opening shell and the cable-passageway shell and wherein can be configured to be connected to the access-opening shell.

This disclosure also includes a method for covering a lift station. This method can include positioning the disclosed cover assembly on a lift station and routing one or more cables between the interior of the lift station and the exterior of the lift station through the cable passageway in the cover assembly. In some embodiments, the cables are laid in place without being threaded through any portion of the cable passageway. In addition, airflow through the cable passageway can be blocked around the cables. This can be done, for example, by applying foamed insulation to the cable passageway so that it substantially surrounds the cables.

DETAILED DESCRIPTION

Figure 1:
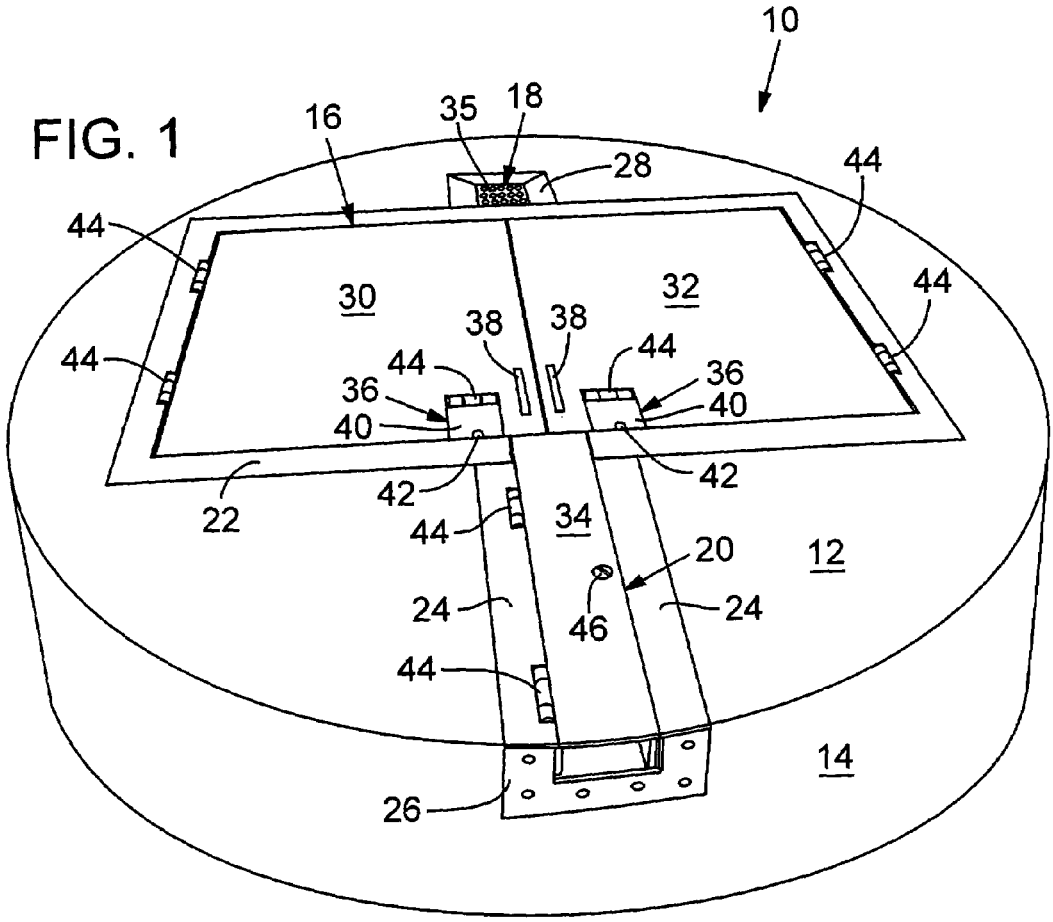
FIG. 1 is a perspective view of an embodiment of a lift station cover with all hatches and grate sections closed.

Throughout this disclosure, the singular terms "a," "an," and "the" include plural referents unless the context clearly indicates otherwise. Similarly, the word "or" is intended to include "and" unless the context clearly indicates otherwise.

Described herein are embodiments of a lift station cover, embodiments of a cable routing configuration, embodiments of components of a lift station cover and embodiments of a method for covering a lift station. Among the disclosed components of a lift station cover are embodiments of a shell assembly. The same reference numerals are used in FIGS. 1-5 to indicate similar or identical features.

FIG. 1 shows one embodiment of a lift station cover 10 having a top surface 12 and a side surface 14. As illustrated, the lift station cover 10 is generally circular, but other shapes also may be suitable. Defined in the lift station cover 10 are an access opening 16, a vent 18 and a cable passageway 20. As illustrated, the access opening 16, the vent 18 and the cable passageway 20 each are generally rectangular. The access opening 16 is positioned at an approximately central location on the lift station cover 10. An access-opening frame 22 extends around the perimeter of the access opening 16, except where the access opening 16 meets the cable passageway 20. In the illustrated implementation, a cable-passageway frame 24 extends on each side of the cable passageway 20 between the access-opening frame 22 and a cable-passageway bolt plate 26. The cable-passageway bolt plate 26 protrudes slightly from the side surface 14 of the lift station cover 10. Unlike the side surface 14 of the lift station cover 10, the cable-passageway bolt plate 26 is flat to facilitate the attachment of other flat components. A vent frame 28 extends around three sides of the vent 18, such that the vent 18 is surrounded by the vent frame 28 and a portion of the access-opening frame 22.

In the illustrated implementation, the access opening 16 is covered by a first access-opening hatch section 30 and a second access-opening hatch section 32. The cable passageway 20 is covered by a cable-passageway hatch 34. The vent 18 is covered by a vent cover 35. The first access-opening hatch section 30 and the second access-opening hatch section 32 each have a lock compartment 36 and a handle 38. Each lock compartment 36 is covered by a lock-compartment hatch 40. Within each lock compartment 36, there is a slot through which an anchor (not shown) protrudes when the respective access-opening hatch section 30, 32 is closed. Padlocks can be positioned within the lock compartments 36 and attached to the anchors (not shown) to prevent unauthorized access. The lock-compartment hatches 40 can be gripped and opened at lock-compartment hatch notches 42.

The first access-opening hatch section 30, the second access-opening hatch section 32 and the cable-passageway hatch 34 are attached to the lift station cover 10 by hinges 44. Hinges 44 also attach the lock-compartment hatches 40 to the access-opening hatch sections 30, 32. The cable-passageway hatch 34 is held in place by a slam lock (not shown) attached to a slam-lock bolt 46.

The cable-passageway hatch 34 can be configured to allow access only when the access opening 16 is being accessed. For example, the cable-passageway hatch 34 can have a tongue (not shown) that extends under the access-opening hatch sections 30, 32. Because the access-opening hatch sections 30, 32 overlap the tongue (not shown), the cable-passageway hatch 34 is prevented from opening while the access-opening hatch sections 30, 32 are closed. Thus, the padlocks positioned within the lock compartments 36 are capable of securing the cable-passageway hatch 34 in addition to the access-opening hatch sections 30, 32.

Figure 2:
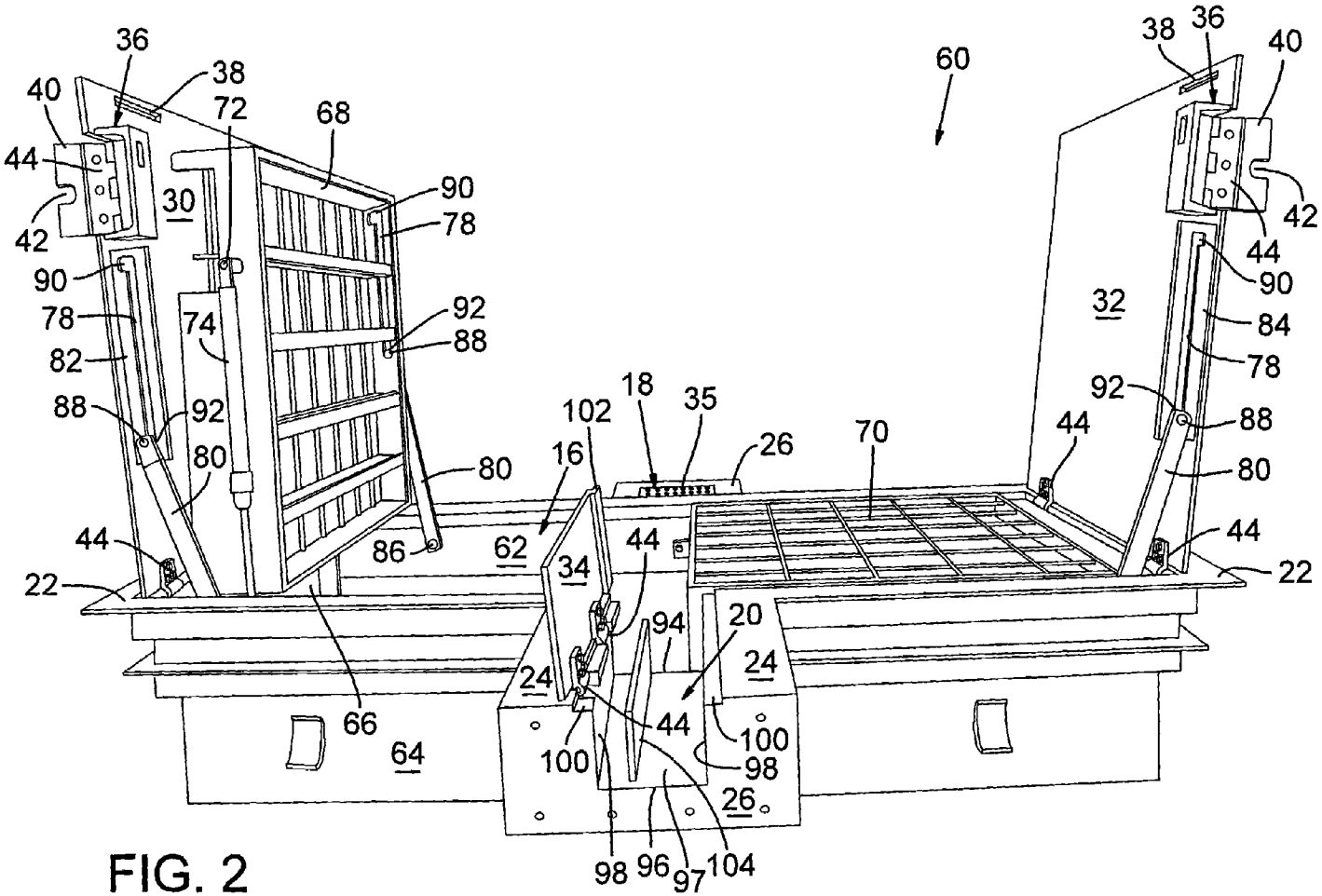
FIG. 2 is a perspective view of an embodiment of a shell assembly for incorporation into a lift station cover, such as is shown in FIG. 1, with one grate section closed, one grate section open, both access-opening hatch sections open and the cable-passageway hatch open.

FIG. 2 shows an embodiment of a shell assembly 60 for incorporation into a lift station cover. In some installations, the shell assembly 60 is surrounded by a support structure to form a complete lift station cover, such as the lift station cover 10 shown in FIG. 1. The access opening 16 and the vent 18 both are intended to extend into the interior of a lift station well over which the shell assembly 60 ultimately is installed. Thus, the shell assembly 60 includes walls that can isolate the access opening 16 and the vent 18 from the material, such as concrete, used to form the portion of the lift station cover surrounding the shell assembly 60. The access-opening 16 is bordered by a first wall 62, a second wall (not shown), a third wall 64 and a fourth wall 66. The vent 18 is positioned adjacent the access-opening frame 22 along the first wall 62 of the access opening 16. The cable passageway 20 is positioned adjacent the access opening 16 along the third wall 64 of the access opening 16. A first grate section 68 and the first access-opening hatch section 30 are connected to the shell assembly 60 along the fourth wall 66 of the access opening 16. A second grate section 70 and the second access-opening hatch section 32 are connected to the shell assembly 60 along the second wall (not shown) of the access opening 16.

The first and second grate sections 68, 70 and the first and second access-opening hatch sections 30, 32 are hingedly mounted to the shell assembly 60 so that they can be opened and closed over the access opening 16. The first and second access-opening hatch sections 30, 32 are attached to the fourth wall 66 of the access opening 16 and the second wall (not shown) of the access opening 16, respectively, by hinges 44. In the illustrated embodiment, the first grate section 68 is attached to a first end 72 of a pneumatic piston 74. A second end (not shown) of the pneumatic piston 74 is rotatably connected to the third wall 64 of the access opening 16. The second grate section 70 is connected to the third wall 64 of the access opening 16 in a similar fashion.

The hinge mechanisms for the first and second grate sections 68, 70 and the first and second access-opening hatch sections 30, 32 include a channel 78 and a bracing arm 80. The channel 78 of the first access-opening hatch section 30 is formed within a first channel plate 82 attached to the bottom surface of the first access-opening hatch section 30. The channel 78 of the second access-opening hatch section 32 is formed within a second channel plate 84 attached to the bottom surface of the second access-opening hatch section 32. In contrast to the first and second access-opening hatch sections 30, 32, the channels 78 of the first and second grate sections 68, 70 are formed directly in the first and second grate sections 68, 70. Each bracing arm 80 has a pivot 86 on one end and a channel connector 88 on the other end. The pivots 86 of the bracing arms 80 attached to the first and second access-opening hatch sections 30, 32 are rotatably mounted to the third wall 64 of the access opening 16. The pivots 86 of the bracing arms 80 attached to the first and second grate sections 68, 70 are rotatably mounted to the first wall 62 of the access opening 16. Each channel connector 88 is slidably connected to one of the channels 78. As the first or second grate section 68, 70 or the first or second access-opening hatch section 30, 32 is opened, the respective bracing arm 80 rotates at its pivot 86 while its channel connector 88 slides along the associated channel 78 from a channel notch 90 to an end point 92. After the channel connector 88 reaches the end point 92, the first or second grate section 68, 70 or the first or second access-opening hatch section 30, 32 is prevented from opening any further and is prevented from closing without manually raising the bracing arm 80.

The cable passageway 20 has a first end 94, a second end 96 and bottom and side walls 97, 98, extending between the first and second ends 94, 96. The cable passageway 20 is in communication with the access opening 16. More specifically, in the illustrated embodiment, the open first end 94 is positioned at the third side wall 64 of the access opening 16. The second end 96 of the cable passageway 20 extends to the exterior of the shell assembly 60, and, in the illustrated embodiment, includes the bolt plate 26. The cable-passageway hatch 34 is hingedly mounted along one of the side walls 98 of the cable passageway 20 with hinges 44. Near the top of the side walls 98 of the cable passageway 20 there are ledges 100. When the cable-passageway hatch 34 is closed, some parts of the cable-passageway hatch 34 rest on the ledges 100. In addition, the cable-passageway hatch 34 has a lip 102 that extends beyond the ledges 100 and fits under the first and second access-opening hatches 30, 32 when all the hatches are closed. To physically isolate certain cables from other cables, the cable passageway 20 is divided into two sections by a divider 104.

Figure 3:
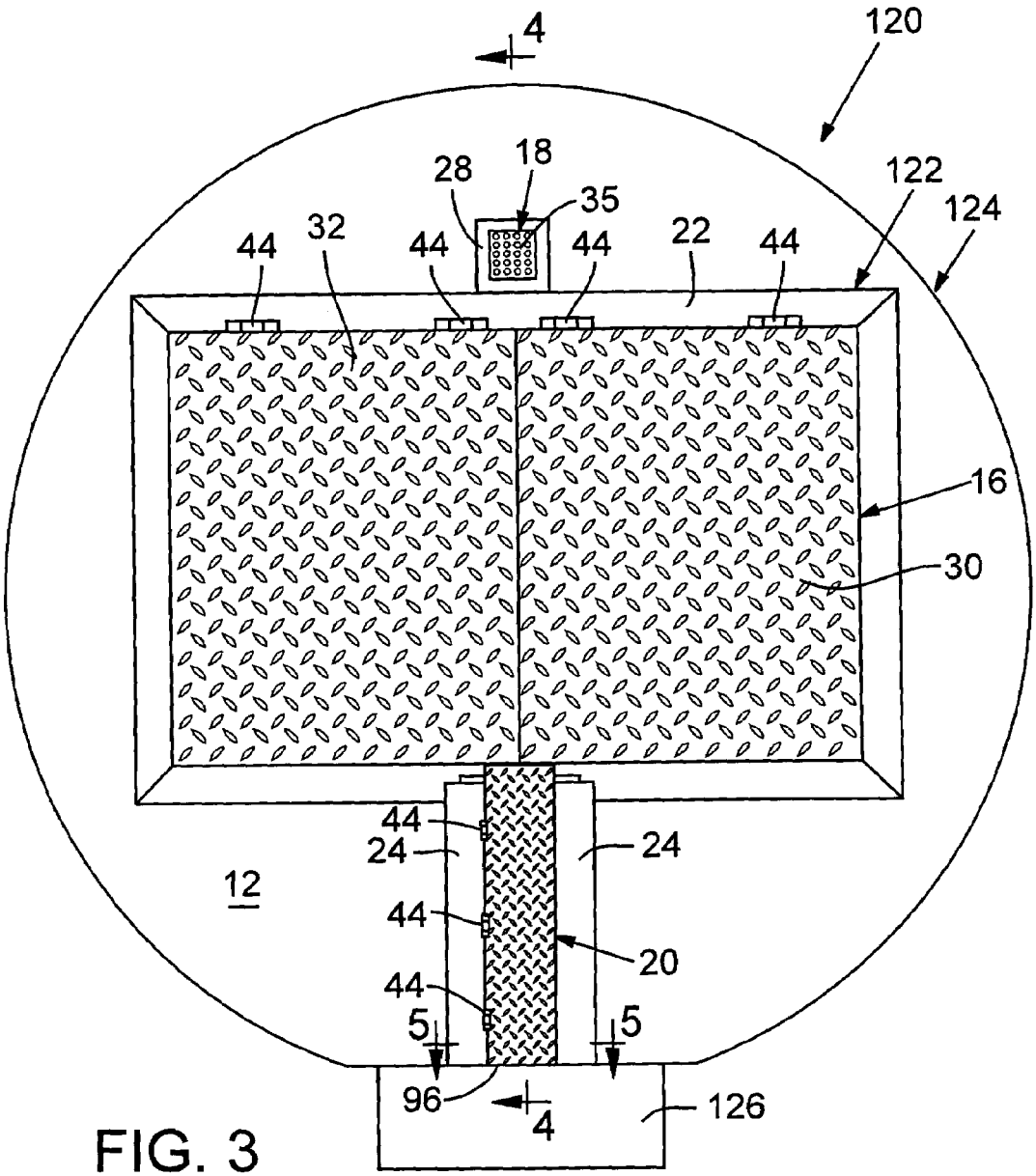
FIG. 3 is a plan view of an embodiment of a lift station cover with all of the hatches and grate sections closed.

FIG. 3 is a plan view of another embodiment of a lift station cover 120. In this embodiment, the lift station cover 120 comprises a shell assembly 122 and a poured concrete portion 124 surrounding the shell assembly 122. The first access-opening hatch section 30 and the second access-opening hatch section 32 are attached to the lift station cover 120 along the first wall (not shown) of the access opening 16. In addition, a disconnect box 126 is shown adjacent the second end 96 of the cable passageway 20. The disconnect box 126 is elevated above the top surface 12 of the lift station cover 120.

Figures 4, 5:
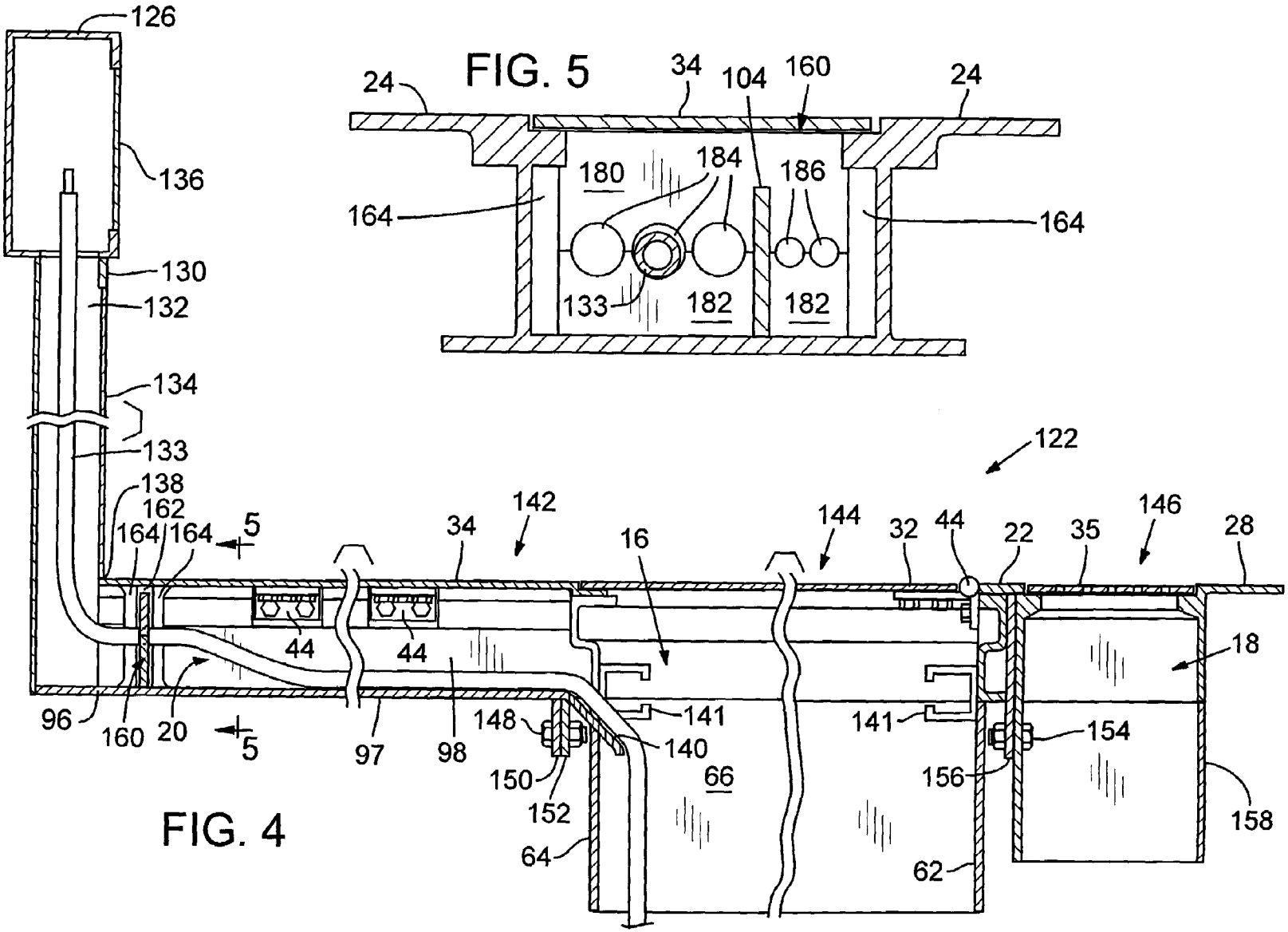
FIG. 4 is a cross sectional view of the shell assembly of the lift station cover illustrated in FIG. 3 taken along the line 4-4.
FIG. 5 is a cross sectional view of the cable passageway of the lift station cover illustrated in FIG. 3 taken along the line 5-5.

FIG. 4 is a cross sectional view of the shell assembly 122 of the lift station cover 120 taken along the line 4-4 in FIG. 3, except the poured concrete portion 124 surrounding the shell assembly 122 is not shown. FIG. 4 does show a disconnect-box stand 130 extending vertically near the second end 96 of the cable passageway 20. The disconnect-box stand 130 has a hollow interior 132 in communication with the disconnect box 126 and the cable passageway 20. A cable 133 is shown extending from the disconnect box 126, through the hollow interior 132 of the disconnect box stand 130, through the cable passageway 20 and through the access opening 16 into the interior of the lift station well. The disconnect-box stand 130 has a disconnect-box stand door 134 that can be opened to allow access to cables running through the hollow interior 132 of the disconnect-box stand 130. Similarly, the interior of the disconnect box 126 can be accessed through a disconnect box door 136. The disconnect-box stand door 134 and the disconnect box door 136 each have locks (not shown). The disconnect-box stand door 134 has a bottom edge 138 that overlaps the cable-passageway hatch 34 when the disconnect-box stand door 134 and the cable-passageway hatch 34 are closed. When the disconnect-box stand door 134 is closed and locked, the cable-passageway hatch 34 cannot be opened. This serves as another locking mechanism for the cable-passageway hatch 34.

As shown in FIG. 4, the shell assembly 122 has a slide 140 at the junction between the cable passageway 20 and the access opening 16. The slide 140 is useful for supporting cables, such as cable 133, that travel between the cable passageway 20 and the access opening 16. The slide 140 is particularly useful for preventing the cables from getting caught at the junction between the cable passageway 20 and the access opening 16 as they are fed into or withdrawn from the interior of the lift station well. FIG. 4 also shows guide rail channels 141 extending horizontally along the inside surfaces of the first and third walls 62, 64 of the access opening 16. The guide rail channels 141 can be used to support vertical guide rails (not shown). The vertical guide rails can be slidingly engaged with pumps (not shown) to facilitate the process of raising and lowering the pumps, e.g. for maintenance.

In the embodiment illustrated in FIG. 4, the cable passageway 20 is contained within a first piece 142, the access opening 16 is contained within a second piece 144 and the vent 18 is contained within a third piece 146. The first piece 142 is attached to the second piece 144 by cable-passageway bolts 148 extending through a first bolt plate 150 and a second bolt plate 152. The second piece 144 is attached to the third piece 146 by vent bolts 154 extending through a third bolt plate 156 and a vent skirt 158.

FIG. 4 shows a cable support 160 positioned across the cable passageway 20 near the second end 96 of the cable passageway 20. The cable support 160 fits snugly across the cable passageway 20 in a cable-support groove 162. The cable-support groove 162 is formed by two sets of cable-support groove plates 164. The cable support 160 is illustrated in greater detail in FIG. 5, which is a cross sectional view of the cable passageway 20 taken along the line 5-5 in FIG. 3. The cable support 160 is divided into a top piece 180 and two bottom pieces 182. The top piece 180 is removable to allow cables, such as cable 133, to be inserted between the top piece 180 and the bottom piece 182. Power cables can be positioned within power cable holes 184. Sensor cables can be positioned within sensor cable holes 186. The power cable holes 184 and the sensor cable holes 186 are on opposite sides of the divider 104 to prevent the power cables from interfering with signals traveling through the sensor cables. When the cables are in position, the top piece 180 can be replaced and unused power cable holes 184 and sensor cable holes 186 can be covered.

The embodiments illustrated in FIGS. 1-5 are merely exemplary. The various elements of the embodiments illustrated in FIGS. 1-5 can be interchanged to provide additional embodiments with different functional characteristics. This disclosure also describes additional embodiments not limited to the particular features illustrated in FIGS. 1-5.

A typical lift station includes a well that receives and stores a collected liquid, such as sewage, storm water or any other liquid that needs to be moved against the force of gravity. For safety, containment and other reasons, lift station wells must be covered. The disclosed lift station cover can be used to cover any type of lift station well. Embodiments of the disclosed lift station cover can be used, for example, to cover wells of different sizes and shapes, modular wells, non-modular wells, buried wells, above-ground wells and wells made of a variety of materials. Some of the features that may be present in embodiments of the disclosed lift station cover are described in the following subsections.

Access Opening, Grate and Access-Opening Hatch

Some embodiments of the disclosed lift station cover include an access opening 16 extending from the exterior of the lift station to the interior of the lift station well. The access opening 16 can be the route through which workers and equipment pass into and out of the lift station well. Cables connected to equipment positioned inside the lift station well also can pass through the access opening 16.

In some disclosed embodiments, the access opening 16 has a cover, such as an access-opening hatch. The access-opening hatch, for example, can be hingedly attached to the edges of the access opening 16. In some disclosed embodiments, the access-opening hatch comprises two or more access-opening hatch sections 30, 32 that can be opened to uncover the access opening 16. The access-opening hatch can be made of a variety of materials, such as aluminum, PVC or steel. In some disclosed embodiments, the access-opening hatch is substantially solid and, when closed, covers substantially the entire access opening 16. For security, the access-opening hatch can include a locking mechanism, such as a lock compartment 36 configured to hold a padlock. The padlock, for example, can be attached to a fixed anchor that protrudes through a slot in the lock compartment 36 when the access-opening hatch is closed. In some embodiments, the access-opening hatch has a top surface that is substantially flush with the top surface of the overall lift station cover. Lock compartments and handles, if present, can be recessed relative to the top surface of the access-opening hatch so that the top surface of the access-opening hatch is substantially uninterrupted by protrusions.

In some disclosed embodiments, a grate is positioned across the access opening 16 below the access-opening hatch. This grate can be useful as a platform for workers and equipment. Like the access-opening hatch, the grate can be divided into two or more sections 68, 70. During maintenance, for example, one section can be closed while another section is open. Workers can stand on the closed section and lower equipment through the open section. If necessary for certain activities, all of the grate sections can be opened to fully expose the interior of the lift station well.

Cable Passageway and Cable-Passageway Hatch

Equipment located within a lift station well typically must be connected to power sources, control panels, quick disconnect couplings and other equipment located outside the lift station well. Some embodiments of the disclosed lift station are configured to facilitate the routing of cables between the exterior of the lift station and the interior of the lift station. For example, some embodiments comprise a cable passageway 20 that extends between the exterior of the lift station and the interior of the lift station. The interior of the lift station can include all portions of the lift station that are in communication with the interior of the lift station well, including the cable passageway and the access opening.

The cable passageway 20 typically is substantially horizontal, while the access opening 16 typically is substantially vertical. In some disclosed embodiments, the cable passageway 20 extends horizontally from the exterior of the lift station into a wall of the access opening 16. In this way, cables can be routed horizontally from the exterior of the lift station to the access opening 16 through the cable passageway 20 and then routed down through the access opening 16 into the interior of the lift station well. The end of the cable passageway 20 that opens to the exterior of the lift station typically is located near the perimeter of the main structure of the lift station cover, such as along a side wall of the lift station cover. Spatially, the main structure of the lift station cover can be defined by the support structure and the shell assembly. The exterior of the lift station well can be any area outside of the main structure of the lift station cover, including any area within external elements, such as external electrical equipment, stands for external electrical equipment and extensions of the cable passageway 20.

The junction between the cable passageway 20 and the access opening 16 can be configured to facilitate the routing of cables. The junction can be formed, for example, without any sharp corners. In addition, a slide 140 can be positioned at the junction to support the cables. This slide 140 can be a simple plate positioned at an angle between the angle of the cable passageway 20 and the angle of the access opening 16. The point at which the slide 140 meets the cable passageway 20 can be rounded.

In some disclosed embodiments, the cable passageway 20 includes a divider 104, which can be positioned along the length of the cable passageway 20 to separate different types of cables. The divider 104 can be useful, for example, to separate electrical cables from level sensor cables. If these two types of cables are not separated, it is possible for the electromagnetic field surrounding the electrical cables to interfere with the signals being transferred by the level sensor cables.

Like the access opening 16, the cable passageway 20 typically is covered. It can be useful, however, to have easy access to the interior of the cable passageway 20 to facilitate the installation and maintenance of equipment. To allow such access, the cable passageway 20 can be covered, for example, by a cable-passageway hatch 34 hingedly attached to an edge of the cable passageway 20. Like the access-opening hatch, the cable-passageway hatch 34 can comprise two or more sections and can be made of a variety of materials, such as aluminum, PVC or steel. In some disclosed embodiments, the cable-passageway hatch 34 is substantially solid and, when closed, covers substantially the entire cable passageway 20. This can be important, for example to provide an obstacle to the movement of flammable or toxic gas from the interior of the lift station well to the exterior of the lift station.

In ordinary operation, the cables within the cable passageway 20 typically do not fill the cable passageway 20. Therefore, it can be useful to incorporate a barrier within the cable passageway 20 around the cables to serve as an additional obstacle to the movement of flammable or toxic gas from the interior of the lift station well to the exterior of the lift station. This barrier can be, for example a cable support 160 positioned perpendicular to the length of the cable passageway 20 and configured to substantially block the cable passageway 20 around the cables. The cable support 160 can be a plate that slides into the cable passageway 20 and is held in place by cable-support grooves 162 on either side of the cable passageway 20.

The disclosed cable support 160 can extend around the cables in a variety of ways. In some disclosed embodiments, the cable support 160 is flexible and capable of conforming to the shape of the cables. In other embodiments, the cable support 160 is rigid with cable holes to accommodate the cables. The diameter of the cable holes can be sized according to the diameter of cables typically used with lift station equipment.

The cable support 160 also can have cable holes of several different sizes to accommodate different sized cables. Cable holes that are not in use can be blocked, such as with adhesive tape. Both flexible and rigid cable supports can be separable into two or more pieces to allow cables to be introduced and removed without having to thread the cables through the cable support 160. With rigid cable supports, the junction between the pieces can be positioned to bisect the cable holes. Cables can be introduced by separating the pieces of the cable support 160, such as by sliding a top piece out of the cable-support grooves 162, laying the cables into the cable holes and then reassembling the cable support 160 around the cables.

As an alternative to a cable support 160, in some disclosed embodiments, the cable passageway 20 is blocked around the cables with a disposable material that can be broken apart and discarded each time the cables are accessed. One example of a suitable material for blocking the cable passageway 20 is an insulation material that is applied as a liquid or foam. Many of these materials can be sprayed or poured into the cable passageway 20 and then expand to substantially block the cable passageway 20. Examples of suitable materials include foamed polymers, such as foamed polyurethane.

In some disclosed embodiments, the cable-passageway hatch 34 is contiguous with the access-opening hatch when the cable-passageway hatch 34 and the access-opening hatch are closed. In this configuration, the cable-passageway hatch 34 can be at least partially secured by the access-opening hatch. For example, the cable-passageway hatch 34 can have a lip 102 that extends under the access-opening hatch when both hatches are closed. Due to this lip 102, the cable-passageway hatch 34 can only be opened after the access-opening hatch is opened. Thus, a lock on the access-opening hatch is capable of securing both hatches. The lip 102 can be an edge of the cable-passageway hatch 34, such as an edge recessed relative to the remainder of the cable-passageway hatch 34 or simply a flat edge that is at a uniform level with the remainder of the cable-passageway hatch 34.

In some embodiments in which the cable-passageway hatch 34 is contiguous with the access-opening hatch and in some other embodiments, the cable passageway 20 and the portion of the access opening 16 adjacent the cable passageway 20 can be fully uncovered. With the cable passageway 20 and the portion of the access opening 16 adjacent the cable passageway 20 fully uncovered, it may be possible to install or remove cables without threading the cables through any closed spaces within the cable passageway 20 or within the portion of the access opening 16 adjacent the cable passageway 20. This facilitates installation and removal of the cables because the extensive manipulation that would be required to thread the cables through closed spaces can be avoided. In some cases the cables can be laid in place and then moved even after the cables have been connected to large and/or immovable objects at both ends.

External Elements

The disclosed lift station cover can include various elements external to the main structure of the lift station. These elements include, but are not limited to, external electrical equipment, stands for external electrical equipment and extensions of the cable passageway 20 beyond the main structure of the lift station.

One common piece of external electrical equipment that can be used in conjunction with the disclosed lift station is a disconnect box 126. A disconnect box 126 provides convenient, above-ground access to electrical connections, such as those typically required for the pump and sensors in a lift station. In typical installations, the electrical connections in the disconnect box 126 are configured as plug-type connections, such as quick-disconnect couplings that can be connected and disconnected by hand, and without requiring personnel with a special certification (e.g., an electrician). Because electrical connections can be a potential ignition source, fire codes often mandate that disconnect boxes for lift stations be elevated. In some disclosed embodiments, the disconnect box 126 is at least about 48 inches above the ground. Elevating the disconnect box 126 may permit standard electrical connections to be used, as opposed to the special explosion-proof connections that typically must be used within the lift station well. For safety and security, the disconnect box 126 can be fitted with a weather-proof and locking cover.

In some disclosed embodiments, external electrical equipment, such as the disconnect box 126, is connected to a stand 132. The stand 132 can be hollow so as to allow cables to be routed up into the equipment from below. The stand 132 can be positioned near the end of the cable passageway 20 that opens to the exterior of the lift station. Thus, cables exiting the cable passageway 20 can be routed directly up to the equipment. In some cases, it can be useful to have access to the hollow interior of the stand 132. Therefore, in some disclosed embodiments, the stand 132 has a stand door 134. When the stand 132 is positioned adjacent the end of the cable passageway 20 that opens to the exterior of the lift station, the stand door 134 also can partially secure the cable-passageway hatch 34. For example, the stand door 134 can have a bottom edge 138 that overlaps the cable-passageway hatch 34 when the stand door 134 is closed so that the cable-passageway hatch 34 cannot be opened until the stand door 134 is opened. In some disclosed embodiments, the stand 132 and/or the stand door 134 is/are perforated to allow for the movement of air between the hollow interior of the stand 132 and the outside environment.

Like the junction between the cable passageway 20 and the access opening 16, the junction between the cable passageway 20 and the hollow interior of the stand 132 can be designed to facilitate installation and removal of the cables. For example, in some embodiments, when the cable-passageway hatch 34 and the stand door 134 are open, the cable passageway 20 and the portion of the hollow interior of the stand 132 adjacent the cable passageway 20 are fully uncovered and contain no closed spaces through which cables must be threaded. In embodiments that do have closed spaces through which the cables must be threaded, particularly in the upper portion of the stand 132, these closed spaces can be formed without sharp corners.

In some disclosed embodiments, the cable passageway 20 is extended with an external cable passageway extension. Extension of the cable passageway 20 is useful, for example, to route the cables to equipment at a distant location. It also can be useful to prevent a stand 132 positioned at the end of the cable passageway 20 from interrupting the continuity of the top surface of the lift station cover. The top surface of the lift station cover may need to be uninterrupted, for example, to allow vehicles to drive over the lift station cover. In some disclosed embodiments, the cable passageway 20 is extended with modular sections. These modular sections can be connected, for example, at bolt plates located at the ends of each section. Angled and curved sections can be used to route the extension to locations that are not aligned with the end of the cable passageway 20. Angled and curved sections also can be used to route the extension around obstacles.

Vent

For certain applications, it may be necessary to vent gases from the interior of the lift station well. Venting, for example, can prevent toxic or flammable gases from building up to dangerous levels within the lift station well. Venting also can be useful for equilibrating the air pressure inside the lift station well with the air pressure of the outside environment.

Some embodiments of the disclosed lift station cover include a vent 18. Certain fire codes impose extra restrictions on equipment positioned less than a specified distance, such as 60 inches, from a lift station vent. Some disclosed embodiments are configured so that the vent 18 is separated from electrical equipment. For example, in some disclosed embodiments, the vent 18 is spaced from the cable passageway 20. The vent 18 and the cable passageway 20, for example, can be positioned on opposite sides of the access opening 16. Separating the vent 18 from the cable passageway 20 can be helpful because the cable passageway 20 carries electrical cables and typically is located near external electrical equipment, such as the disconnect box 126.

The vent 18 in disclosed embodiments typically is a passive vent, particularly if flammable gases are being vented. Fans and other equipment can be used, but may need to be explosion-proof to comply with applicable fire codes.

Shell Assembly

Some disclosed embodiments of the lift station cover include a shell assembly.

The shell assembly can include all of the elements of the disclosed lift station cover other than the support structure. The support structure typically is the poured concrete structure surrounding the shell assembly. The shell assembly can be prefabricated under controlled conditions to achieve a level of quality that would be difficult to achieve in the field. Prefabricating the shell assembly also significantly reduces the cost of installation. The support structure can be prefabricated with the shell assembly or poured at the installation site. Pouring the support structure at the installation site requires little precision and can reduce the cost of transportation.

The shell assembly can be a single structure or it can be a combination of several separate structures. In some disclosed embodiments, the shell assembly includes a cable passageway shell, an access-opening shell and a vent shell. These, in turn, can be further divided. The cable-passageway shell and the vent shell can be bolted to the access-opening shell, such as on opposite sides of the access opening shell.

The cable-passageway shell typically has a closed bottom, while the access-opening shell and the vent shell typically have open bottoms. The access-opening shell and the vent shell can have walls extending vertically with heights approximately equal to the intended height of the support structure.

Construction and Installation

The disclosed lift station cover typically is exposed to the weather, so it must be made of durable materials. The shell assembly, for example, can be constructed of metal or other suitable material. In some disclosed embodiments, the shell assembly is aluminum with stainless steel hardware. The outside of the shell assembly can be coated to inhibit corrosion. The support structure surrounding the shell assembly typically is constructed of poured concrete, such as 4000 psi concrete. Thicker metal in the shell assembly and reinforced concrete can be used if the lift station cover is intended to support substantial weight, such as the weight of vehicles.

The disclosed lift station cover can be manufactured as an integral portion of a lift station well or it can be manufactured separately. A lift station cover manufactured as a separate component can be attached to a lift station well, for example, with vertical mating sections positioned on the top edge of the walls of the lift station well and the bottom edge of the lift station cover, near its perimeter. Because the water or other liquid in a lift station typically does not reach the level of the lift station cover, a liquid-tight seal between the lift station cover and the lift station well typically is not required. If a liquid-tight seal is required, however, a gasket can be positioned between the lift station cover and the lift station well.

Installation of the disclosed lift station cover can include positioning the lift station cover on top of a lift station well. The proper alignment can be indicated by guide lines on the side of the lift station well and the lift station cover. Installation also can include routing cables from the interior of the lift station to the exterior of the lift station through the cable passageway 20. The cables can be routed, for example, in a generally vertical direction through a portion of the access opening 16 and then in a generally horizontal direction through the cable passageway 20. In some installations, the cables are laid in place without being threaded through any closed spaces in the cable passageway 20 or in the portion of the access opening 16 adjacent the cable passageway 20. After the cables are in place, the cable passageway 20 can be blocked around the cables, such as by applying foam insulation, to restrict the movement of gasses through the cable passageway 20. With the use of prefabricated components and with the improved cable routing features of the disclosed lift station cover, installation often can be accomplished without the need for highly skilled labor (e.g. electricians and plumbers).

Additional Considerations

Some embodiments of the disclosed lift station cover are designed to prevent significant amounts of gas from within the lift station well from escaping through the cable passageway. The cable-passageway hatch 34, for example, can be substantially solid and cover substantially the entire cable passageway 20. In addition, the interior of the cable passageway 20 can be blocked around the cables by the cable support 160 or by some other barrier. The cable-passageway hatch 34 also can be constructed of the same material as the access-opening hatch, such as aluminum.

Although the cable-passageway hatch 34 in some disclosed embodiments is substantially solid and substantially covers the cable passageway 20, it does not necessarily create an air-tight seal. In general, some leakage, such as around the edges of the cable-passageway hatch 34, can be tolerated without compromising safety.

For some applications, it is desirable to configure the disclosed lift station cover to have a flat upper surface when certain components, such as hatches, are in a closed position. This can be helpful, for example, to allow vehicle traffic to pass over the lift station with minimal obstruction. In some disclosed embodiments, the hatches are substantially flush with the top surface of the lift station cover when they are in a closed position. Other components, such as hinges, handles, vents and locks also can be configured so that they do not protrude significantly from the surface of the lift station cover. These components, for example, can be recessed relative to the top surface of the lift station cover.

Having illustrated and described the principles of the invention in exemplary embodiments, it should be apparent to those skilled in the art that the illustrative embodiments can be modified in arrangement and detail without departing from such principles. In view of the many possible embodiments to which the principles of the invention can be applied, it should be understood that the illustrative embodiments are intended to teach these principles and are not intended to be a limitation on the scope of the invention. We therefore claim as our invention all that comes within the scope and spirit of the following claims and their equivalents.

We claim:

1. A cover assembly for a lift station for water or other liquid, comprising:

a cover with an access opening defined therein, wherein the access opening is sized to permit a worker to pass therethrough;

an access-opening hatch configured to at least partially cover the access opening;

a cable passageway defined in the cover and extending from an exterior of the lift station to an interior of the lift station;

a substantially solid cable-passageway hatch configured to cover the cable passageway; and a vent defined in the cover, wherein the cable passageway and the vent are isolated from each other by the access opening.

2. The cover assembly of claim 1, wherein the cable passageway is substantially horizontal and the access opening is substantially vertical when the cover assembly is positioned over a lift station well.

3. The cover assembly of claim 1, wherein the cable passageway is recessed in a top surface of the cover, and wherein a top surface of the access-opening hatch, a top surface of a cable-passageway hatch for the cable passageway and a top surface of the vent are all substantially flush with the top surface of the cover.

4. The cover assembly of claim 1, wherein the cable passageway and the vent are positioned on opposite sides of the access opening.

5. The cover assembly of claim 1, further comprising a cable passageway hatch configured to cover the cable passageway, wherein the cable passageway and an adjacent portion of the access opening are fully uncovered when the cable-passageway hatch and the access-opening hatch are in an open position, such that a cable extending from the exterior of the lift station to the interior of the lift station can be placed into or removed from the cable passageway without being threaded through any closed space within the cable passageway or within the adjacent portion of the access opening.

6. The cover assembly of claim 1, wherein the cable passageway comprises a divider configured to separate power cables from signal cables.

7. The cover assembly of claim 1, wherein the access opening in the cover and an opening of the cable passageway adjacent the access opening occupy intersecting planes.

8. The cover assembly of claim 7, wherein the intersecting planes intersect at an angle of about 90°.

9. The cover assembly of claim 1, wherein the access opening has a side wall and the cable passageway extends into the interior of the lift station through the side wall of the access opening.

10. The cover assembly of claim 9, wherein the cable-passageway hatch is substantially contiguous with the access-opening hatch when the cable-passageway hatch and the access-opening hatch are in a closed position.

11. The cover assembly of claim 10, wherein the cable-passageway hatch comprises a lip configured to extend under the access-opening hatch when the cable-passageway hatch and the access-opening hatch are in the closed position.

12. The cover assembly of claim 1, further comprising a barrier positioned in the cable passageway and configured to substantially block an area of the cable passageway around one or more cables.

13. The cover assembly of claim 12, wherein the barrier comprises a foamed polymer.

14. The cover assembly of claim 12, wherein the barrier comprises a cable support comprising a plate positioned transverse to a cable-passageway length, the plate having one or more openings configured to fit around the one or more cables, wherein the plate is divided along the one or more openings into two or more pieces, such that the one or more cables can be introduced or removed by separating at least one of the two or more pieces.

15. An assembly configured for use with a lift station, comprising:

an access-opening shell with a top surface comprising an access-opening hatch;

a cable-passageway shell with a top surface comprising a substantially solid cable-passageway hatch; and a vent shell with a top surface comprising a vent cover, wherein the access-opening shell defines an access opening sized to permit a worker to pass therethrough, the cable-passageway shell defines a cable passageway, the vent shell defines a vent and the vent is isolated from the cable passageway by the access opening.

16. The assembly of claim 15, wherein the access opening shell has a side wall and the cable passageway terminates at an opening in the side wall such that the cable passageway is in communication with the access opening.

17. The assembly of claim 16, wherein the access-opening hatch and the cable-passageway hatch are substantially contiguous when the cable-passageway hatch and the access-opening hatch are in a closed position.

18. The assembly of claim 17, wherein the cable-passageway hatch comprises a lip configured to extend under the access-opening hatch when the cable-passageway hatch and the access-opening hatch are in the closed position.

19. The assembly of claim 15, wherein the cable-passageway shell comprises a barrier positioned in the cable passageway and configured to substantially block the cable passageway around one or more cables.

20. The assembly of claim 19, wherein the barrier comprises a cable support comprising a plate positioned perpendicular to a cable-passageway length, the plate having one or more openings configured to fit snugly around the one or more cables, wherein the plate is divided along the one or more openings into two or more pieces, such that the one or more cables can be introduced or removed by separating the two or more pieces.

21. The assembly of claim 15, wherein the access-opening shell is separable from the cable-passageway shell, and wherein the access-opening shell and the cable-passageway shell are configured to be connected by a bolted connection.

22. The assembly of claim 21, wherein the vent shell is separable from the access-opening shell and the cable-passageway shell, and wherein the vent shell is configured to be connected to the access-opening shell.

23. A method for covering a lift station for water or other liquid, comprising:

positioning a cover assembly on the lift station, the cover assembly having an access opening defined therein, a cable passageway defined in the cover assembly and extending from a periphery of the cover assembly to the access opening, and a vent defined in the cover assembly at a position isolated from the cable passageway by the access opening and isolated from the access opening, wherein the access opening is sized to permit a worker to pass therethrough; and routing at least one cable between an interior of the lift station and an exterior of the lift station through the cable passageway, the cable remaining isolated from direct impingement of gasses flowing through the vent.

24. The method of claim 23, wherein routing the one or more cables comprises laying the one or more cables in place without threading the one or more cables through any portion of the cable passageway.

25. The method of claim 23, further comprising blocking substantial airflow through the cable passageway around the one or more cables.

26. The method of claim 25, wherein blocking substantial airflow comprises applying foamed insulation to the cable passageway, such that the foamed insulation substantially surrounds the one or more cables.

27. A cover assembly for a lift station for water or other liquid, comprising:

a cover with an access opening defined therein;

an access-opening hatch configured to at least partially cover the access opening;

a cable passageway defined in the cover and extending from an exterior of the lift station to an interior of the lift station;

a substantially solid cable-passageway hatch configured to cover the cable passageway; and a vent defined in the cover, wherein the cable passageway and the vent are isolated from each other by the access opening;

wherein the access opening has a side wall and the cable passageway extends into the interior of the lift station through the side wall of the access opening;

wherein the cover assembly has a top surface, wherein the cable passageway has a first end at the side wall of the access opening and a second end positioned outwardly from the first end, and the cover assembly further comprises:

a disconnect box positioned above the top surface of the cover assembly; and a disconnect-box stand extending from the second end of the cable passageway to the disconnect box, wherein the disconnect-box stand has a disconnect-box stand door with a bottom edge, and the bottom edge of the disconnect-box stand door overlaps the cable-passageway hatch when the disconnect-box stand door and the cable-passageway hatch are in a closed position, such that the cable-passageway hatch cannot be opened without first opening the disconnect-box stand door.

28. A cover assembly for a lift station for water or other liquid, comprising:

a cover with an access opening defined therein;

an access-opening hatch configured to at least partially cover the access opening;

a cable passageway recessed in a top surface of the cover and extending from an exterior of the lift station to an interior of the lift station;

a substantially solid cable-passageway hatch configured to cover the cable passageway; and a vent defined in the cover, wherein:

the cable passageway and the vent are positioned on opposite sides of the access opening and thereby isolated from each other by the access opening, the cable passageway is substantially horizontal and the access opening is substantially vertical when the cover assembly is positioned over a lift station well, the cable passageway having an inner end at an opening defined in a side wall of the access opening;

a top surface of the access-opening hatch, a top surface of the cable-passageway hatch and a top surface of the vent are all substantially flush with the top surface of the cover assembly, and the cable passageway and an adjacent portion of the access opening are fully uncovered when the cable-passageway hatch and the access-opening hatch are in an open position, such that a cable extending from the exterior of the lift station to the interior of the lift station can be placed into or removed from the cable passageway without being threaded through any closed space within the cable passageway or within the adjacent portion of the access opening.

* * * * *